US006974332B2

(12) United States Patent
Ma

(10) Patent No.: US 6,974,332 B2
(45) Date of Patent: Dec. 13, 2005

(54) SOCKET CONNECTOR CONTACT WITH HELICAL RESILIENT PORTION

(75) Inventor: Hao-Yun Ma, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/867,984

(22) Filed: Jun. 14, 2004

(65) Prior Publication Data

US 2004/0253847 A1 Dec. 16, 2004

(30) Foreign Application Priority Data

Jun. 13, 2003 (TW) ..... 92210865 U

(51) Int. Cl.[7] ..... H01R 12/00
(52) U.S. Cl. ..... 439/66; 439/71
(58) Field of Search ..... 439/66, 71, 700, 439/862

(56) References Cited

U.S. PATENT DOCUMENTS 4,961,709 A * 10/1990 Noschese ..... 439/66
5,139,427 A 8/1992 Boyd et al.
5,259,769 A 11/1993 Cruise et al.
5,297,967 A * 3/1994 Baumberger et al. ..... 439/66
5,378,160 A 1/1995 Yumibe et al.
5,820,389 A 10/1998 Hashiguchi
6,193,523 B1 2/2001 Harper
6,561,817 B1 * 5/2003 Ma ..... 439/66
6,572,386 B1 * 6/2003 Howell et al. ..... 439/66

* cited by examiner

*Primary Examiner*—Ross Gushi
(74) *Attorney, Agent, or Firm*—Wei Te Chung

(57) ABSTRACT

A socket connector contact (10) comprises a resilient portion (16) having a helical body (16*a*) with an axis. A mating portion (16*b*) extends upwardly from the body, for electrically engaging a mating conductive member (32). When the contact engages the conductive member, the mating portion elastically deflects downwardly at an angle relative to the axis of the body so as to wipe oxidization films that have grown on the mating portion and the conductive member. Furthermore, the body doest not deflect relative to the axis thereof. Rather, the body is compressed along the axis thereof to supply sufficient normal contact force, thereby assuring engagement between the mating portion and the conductive member. Thus, the mating portion and the resilient portion of the contact are used to optimize wiping characteristics and contact force of the contact, respectively.

20 Claims, 4 Drawing Sheets

SOCKET CONNECTOR CONTACT WITH HELICAL RESILIENT PORTION

BACKGROUND OF THE INVENTION

1. Field of the Invention

The present invention relates to an electrical contact, and more particularly to a high-density socket connector contact for electrical interconnection of an electrical interface such as a central processing unit (CPU) with another electrical interface such as a printed circuit board (PCB).

2. Description of the Prior Art

Generally, an engaging portion of a socket connector contact is exposed to air prior to the socket connector being used. The engaging portion is easily oxidized, and a layer of oxidizing film forms and covers the engaging portion. This can decrease of the integrity of signal transmission through the contact. One way to resolve this problem, it is to use a contact which wipes the layer of oxidizing film off from the engaging portion when the contact is mated with a mating conductive member.

A commonly used wiping means is disclosed in FIG. 4. An LGA (land grid array) type socket connector contact 60 comprises a resilient cantilever 62 with a distal mating portion 64. During mating of the contact 60 with a mating conductive pad 80 of an IC package (not shown), the mating portion 64 wipes a bottom surface of the pad 80, thereby removing any oxidizing films that may have formed on the mating portion 64 and the bottom surface of the pad 80. Thus, unimpeded electrical engagement between the pad 80 and the contact 60 is provided.

The configuration of the cantilever 62 determines not only a horizontal wiping distance of the bottom surface of the pad 80 when the contact 60 mates with the pad 80, but also design parameters of the contact 60 such as mating force, wear and stress on the cantilever 62. In configuring the cantilever 62, all these factors need to be considered together. It is common for a good wiping configuration to be obtained only at the expense of one or more of the other factors. That is, it is very difficult to provide a cantilever 62 having an overall optimal configuration including good wiping characteristics. U.S. Pat. Nos. 5,139,427, 5,259,769, 5,378,160, 5,820,389 and 6,193,523 all disclose wiping means similar to those described above, and each of these patents manifest the problems of optimal configuring as described above.

Accordingly, a new electrical contact that overcomes the above disadvantages is desired.

SUMMARY OF THE INVENTION

An object of the present invention is to provide an electrical contact having good wiping characteristics and providing reliable electrical engagement.

Another object of the present invention is to provide an electrical contact which is easily and simply configured.

To achieve the above objects, the present invention applies an electrical contact comprising a resilient portion. The resilient portion comprises a helical body defining an axis. A mating portion extends slantingly upwardly from an upper end of the body. A mating surface is defined on a topmost portion of the mating portion, for electrically mating with a mating conductive member. When the contact mates with the mating conductive member, the mating surface of the mating portion wipes a bottom surface of the mating conductive member. This wiping action removes any oxidation films that may have formed and covered the mating surface of the mating portion and the bottom surface of the mating conductive member due to their exposure to air prior to use. Unimpeded engagement between the mating conductive member and the mating portion is assured. Furthermore, the body does not deflect relative to the axis thereof during mating. Rather, the body is compressed along the axis thereof. Due to the helical configuration of the body, it has good resilient characteristics. This helps ensure that sufficient normal force is provided for stable engagement between the mating surface of the mating portion and the bottom surface of the mating conductive member. Thus, wiping characteristics and contact force of the contact can be independently optimized respectively by configuring the mating portion and the body of the resilient portion. This makes design of the contact easy and simple.

Other objects, advantages and novel features of the present invention will become more apparent from the following detailed description when taken in conjunction with the accompanying drawings, in which:

DESCRIPTION OF PREFERRED EMBODIMENT OF THE INVENTION

Reference will now be made to the drawings to describe the present invention in detail.

Figure 1:
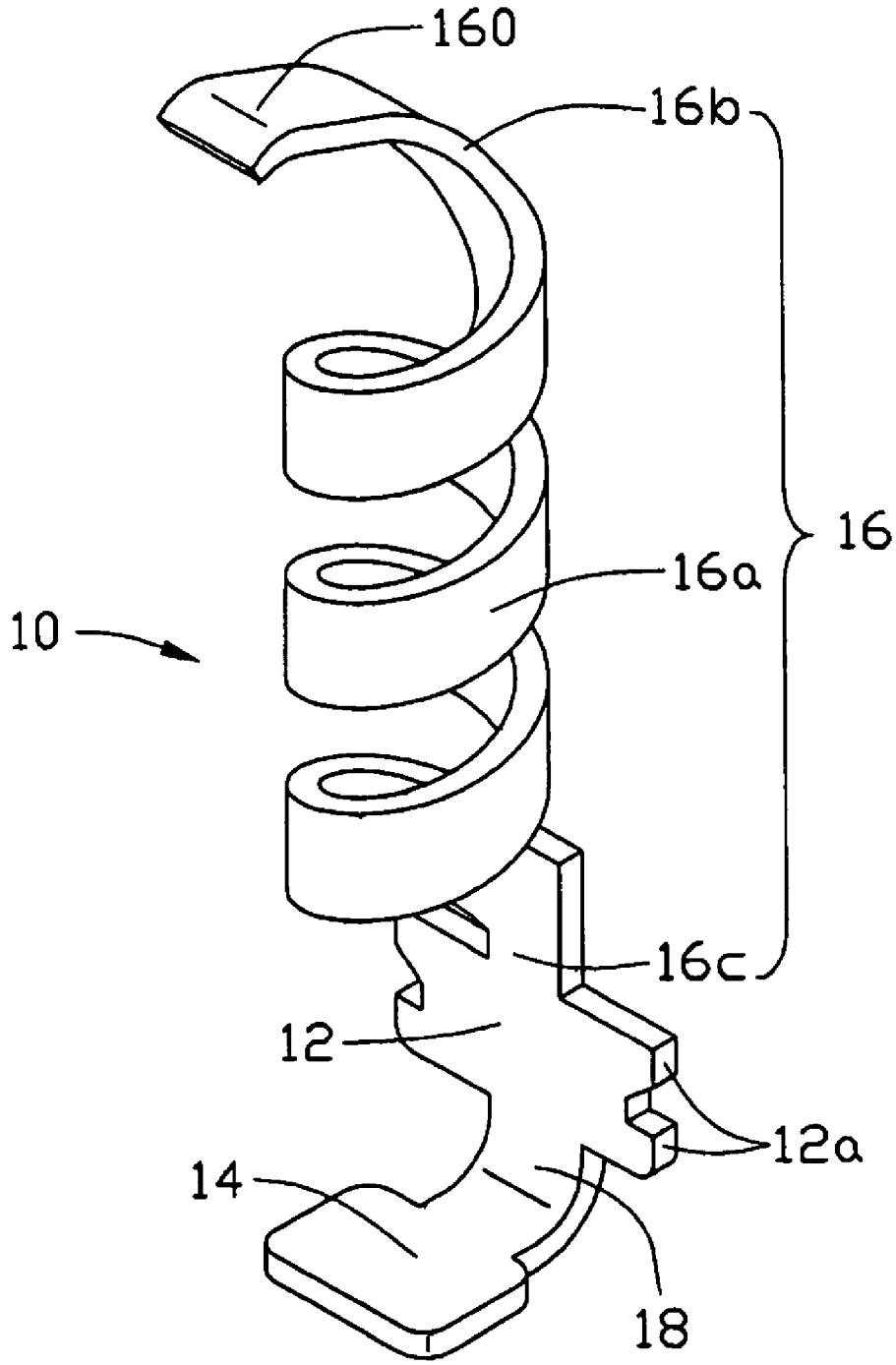
FIG. 1 is an isometric view of a socket connector contact according to the present invention.
Figure 2:
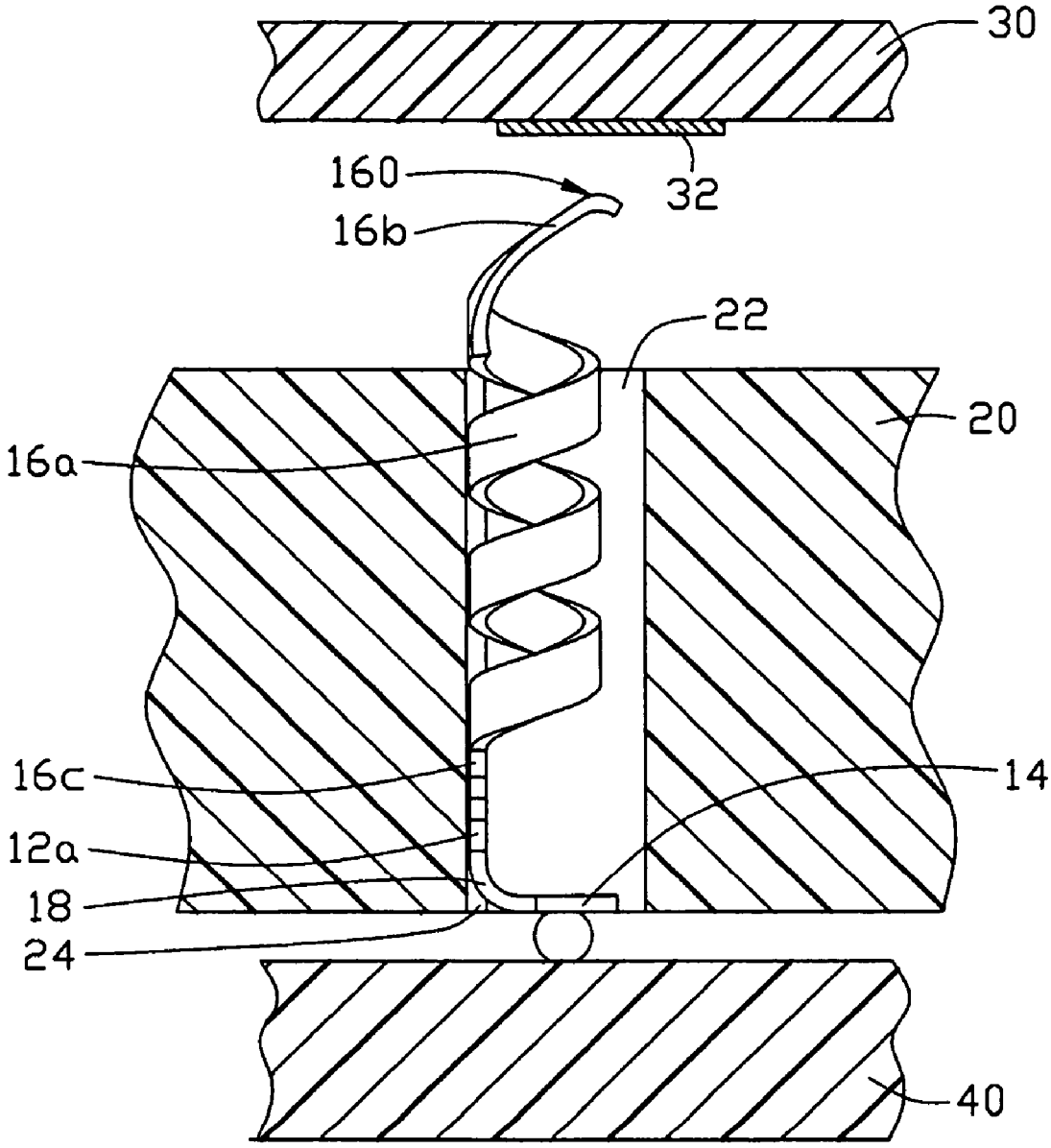
FIG. 2 is a cross-sectional view of part of a socket connector housing having the contact of FIG. 1 received therein, a corresponding part of a CPU ready to be engaged with the contact, and a corresponding part of a PCB on which the contact is engaged.

Referring to FIGS. 1 and 2, an electrical contact 10 according to the present invention is mainly applied for electrically interconnecting two electrical interfaces such as two PCBS. In the preferred embodiment, the contact 10 is used in an LGA-type socket connector (not labeled) that electrically interconnects a CPU 30 and a PCB 40. The socket connector comprises a housing 20 formed from plastic material such as liquid crystal polymer (LCP). A plurality of passages 22 is defined in the housing 20, arranged in columns and rows (not shown). A pair of recesses 24 is defined in the housing 20 at each passage 22, the recesses 24 being at opposite sides of and in communication with the passage 22.

The contact 10 is made by punching a preform from a sheet of metal plate, and then forming the particular shape shown in FIG. 1 by bending. The contact 10 comprises a plate-like retention portion 12. A pair of barbs 12*a* is formed on each of lateral sides of the retention portion 12, for interferentially engaging in a corresponding pair of recesses 24 of the housing 20.

A connecting portion 14 is bent from a lower end of the retention portion 12 so that it is perpendicular to the retention portion 12. The connecting portion 14 has a plate-like configuration for attaching to the PCB 40 via a soldering ball (not labeled). However, other suitable configurations may also be adopted.

A narrowed portion 18 is formed between the retention portion 12 and the connecting portion 14, to facilitate insertion of the barbs 12*a* of the retention portion 12 into the corresponding pair of recesses 24 of the housing 20.

A resilient portion 16 extends upwardly above a top end of the retention portion 12. The resilient portion 16 comprises a helical body 16*a* defining a central axis. After the perform of the contact 10 is punched, the body 16*a* is shaped by a bending process. A narrowed neck 16*c* formed on a bottom of the body 16*a* interconnects the body 16*a* with the top end of the retention portion 12. A mating portion 16*b* extends slantingly upwardly from a top of the body 16*a*. A mating face 160 is defined on a topmost part of the mating portion 16*b*, for mating with a corresponding contact pad 32 of the IC package 30.

Figure 3:
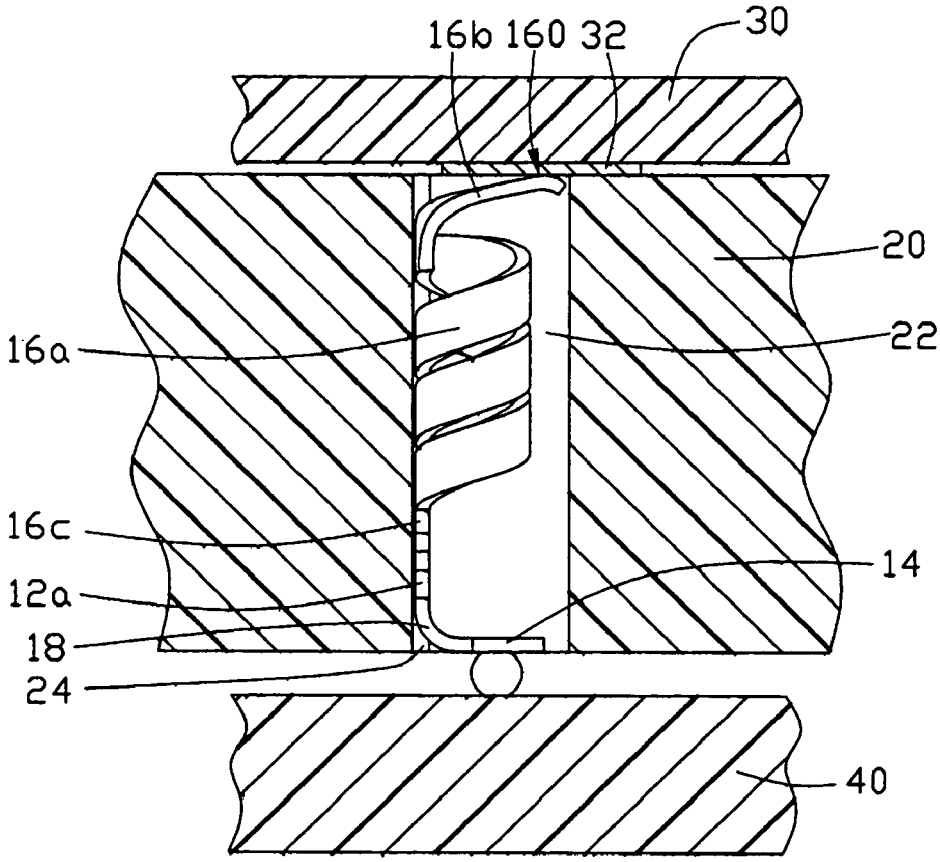
FIG. 3 is similar to FIG. 2, but showing the CPU engaged with the contact.
Figure 4:
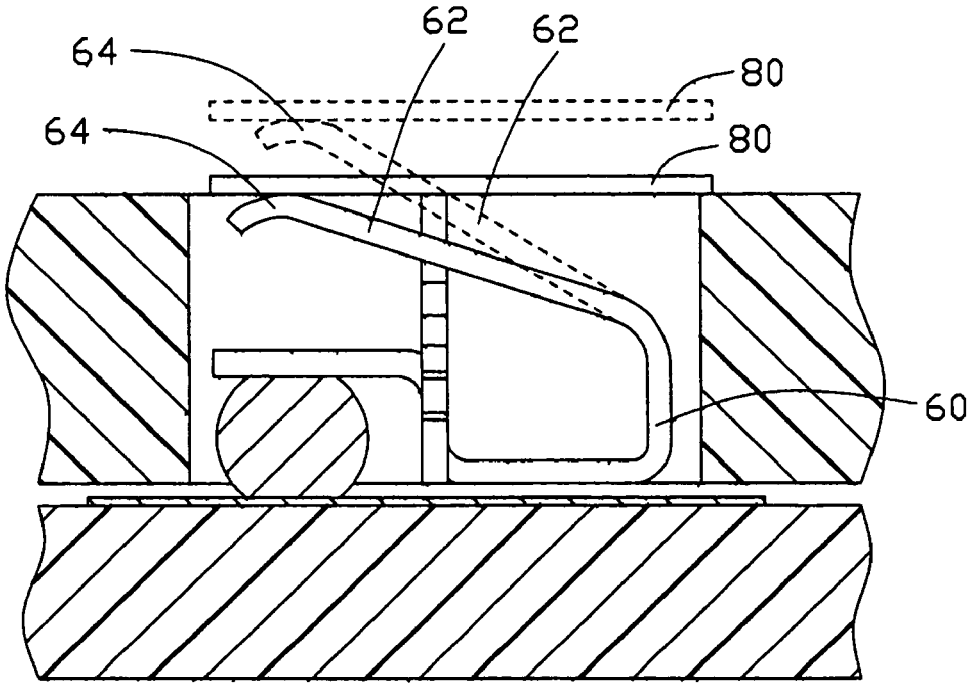
FIG. 4 (PRIOR ART)
FIG. 4 is a schematic, cross-sectional view of part of an LGA-type socket connector housing having a conventional electrical contact received therein, a corresponding conductive pad of a mating IC package, and an electrical interface on which the contact is engaged; and showing in broken lines an earlier stage of mating of the pad with the contact.

Referring also to FIG. 3, in use of the socket connector, the contacts 10 are mated with corresponding pads 32 of the IC package 30. Each pad 32 presses against the mating portion 16*b* of a corresponding contact 10. The mating portion 16*b* elastically deflects downwardly at an angle relative to the axis of the body 16*a*. The mating surface 160 of the mating portion 16*b* wipes a bottom surface of the pad 32. This wiping action removes any oxidation films that may have formed and covered the mating surface 160 of the mating portion 16*b* and the bottom surface of the pad 32 due to their exposure to air prior to use. Unimpeded engagement between the bottom surface of the pad 32 and the mating surface 160 of the mating portion 16*b* is assured. Furthermore, due to the body 16*a* abuts an inner side wall of the passage 22, therefore the body 16*a* does not deflect relative to the axis thereof. As a result, a wiping distance of the mating surface 160 on the bottom surface of the pad 32 is determined only by the mating portion 16*b* and the extent of its deflection, and is not affected by movement of the body 16*a*.

Moreover, the body 16*a* is compressed along the axis thereof. Due to the helical configuration of the body 16*a*, it has good resilient characteristics. This helps ensure that sufficient normal force is provided for stable engagement between the mating surface 160 of the mating portion 16*b* and the bottom surface of the pad 32.

In summary, the two main features of the contact 10 of the present invention are wiping and good contact force. These features can be independently optimized respectively by configuring the mating portion 16*b* and the body 16*a* of the resilient portion 16 according to need. This makes design of the contact 10 easy and simple.

Although the present invention has been described with reference to a particular embodiment, it is not to be construed as being limited thereto. Various alterations and modifications can be made to the embodiment without in any way departing from the scope or spirit of the present invention as defined in the appended claims.

What is claimed is:

1. An electrical contact for an electrical connector comprising a housing defining at least one passage, the contact comprising:

a retention portion being adapted to be secured in a corresponding passage in the housing of the connector;

a connecting portion extending from one end of said retention portion; and a resilient portion extending from an opposite end of said retention portion and comprising a coil-shaped body with an axis and a mating portion extending from a top of the body for mating with a mating conductive member;

wherein when the mating portion mates with said mating conductive member, the body of the resilient portion is compressed substantially along the axis thereof to supply contact force so as to assure engagement between the mating portion and said mating conductive member;

wherein during mating of the mating portion with said mating conductive member, the body abuts against an inner side of the passage, thereby to prevent the body from deflecting away from the axis.

2. The electrical contact of claim 1, wherein the body is divided into a plurality of segments which are each projected on a plane vertical to the axis to form a substantially close projection, all of the projections of the segments are substantially completely overlaid.

3. The electrical contact of claim 1, wherein the body is formed with an out surface parallel to the axis.

4. The electrical contact of claim 3, wherein the mating portion extends slantingly upwardly from the top of the body and defines a mating face for electrically engaging said mating conductive member.

5. The electrical contact of claim 4, wherein the contact is formed from a sheet of metal with a flat surface, the out surface and the mating surface are both formed from the flat surface of the sheet of metal.

6. The electrical contact of claim 1, wherein the retention portion forms at least one barb at one lateral side thereof.

7. The electrical contact of claim 6, wherein the resilient portion further comprises a neck formed at a lower end of the body, the neck being connected to an upper end of the retention portion.

8. An electrical contact assembly comprising:

a conductive member; and a contact comprising a resilient portion comprising a body with an axis and a mating portion extending from an upper end of the body;

wherein when the contact mates with the conductive member, the mating portion elastically deflects downwardly at an angle relative to the axis of the body and the body is compressed substantially along the axis of the body;

wherein the body is shaped to have a helical configuration with a peripheral surface parallel to the axis while the contact is in a free state.

9. The electrical contact assembly of claim 8, wherein the mating portion extends slantingly upwardly from the upper end of the body and defines a mating face for electrical engaging the conductive member.

10. The electrical contact assembly of claim 8, wherein the body is divided into a plurality of segments which are each projected on a plane vertical to the plane to form a close projection, all the projections of the segments are substantially completely overlaid.

11. The electrical contact assembly of claim 8, further comprising a dielectric housing with a passageway for receiving the contact, when the mating portion engages said conductive member, the body abuts against an inner side of the passageway, thereby to prevent the body from deflecting away from the axis.

12. The electrical contact assembly of claim 8, further comprising a plate-like retention portion with a major surface.

13. The electrical contact assembly of claim 12, wherein the axis is parallel to the major surface of the retention portion.

14. The electrical contact assembly of claim 12, further comprising a connecting portion bent perpendicularly from a lower end of the retention portion.

15. The electrical contact assembly of claim 12, wherein the retention portion forms at least one barb at one lateral side thereof.

16. The electrical contact assembly of claim 15, wherein the resilient portion further comprises a neck extending from a lower end of the body, the neck being connected to an upper end of the retention portion.

17. An electrical contact assembly comprising:

a pad type conductive member; and a contact essentially stamped and bent from sheet metal which defines a plane face and a thickness face perpendicularly to said plane face, said contact comprising a resilient portion comprising a coil like body with an axis under a condition that the plane face of said coil like body surrounds said axis in a parallel relation to said axis, and a mating portion extending from an upper end of the body under a condition that a mating face defined by the plane face of a distal end portion of said mating portion extends perpendicular to said axis when said mating portion is downwardly pressed by said conductive member.

18. The electrical contact assembly of claim 17, wherein said contact further includes a retention portion joined at a lower end of the resilient portion, and the axis is parallel to the plane face of said retention.

19. The electrical contact assembly of claim 18, wherein said contact further includes a mounting portion joined with at a lower end of the retention portion, and the axis is parallel to the plane face of said mounting portion.

20. The electrical contact assembly of claim 18, wherein a joint between the resilient portion and the mating portion is located around a vertical plane generally coplanar with said retention portion.

* * * * *